US008011665B2

(12) United States Patent
Stanley

(10) Patent No.: US 8,011,665 B2
(45) Date of Patent: Sep. 6, 2011

(54) BOTTLE CAP GOLF APPARATUS AND METHOD

(76) Inventor: Paul Stanley, Norfolk, VA (US)

( * ) Notice: Subject to any disclaimer, the term of this patent is extended or adjusted under 35 U.S.C. 154(b) by 80 days.

(21) Appl. No.: 12/655,353

(22) Filed: Dec. 30, 2009

(65) Prior Publication Data

US 2011/0156351 A1 Jun. 30, 2011

(51) Int. Cl.
*A63B 67/06* (2006.01)

(52) U.S. Cl. ..... 273/400

(58) Field of Classification Search ..... 273/348, 273/127 R, 126 R, 127 B, 398–402
See application file for complete search history.

(56) References Cited

U.S. PATENT DOCUMENTS

| | | | | | |
|---|---|---|---|---|---|
| 1,211,379 | A | | 1/1917 | Maisch | |
| 3,825,262 | A | | 7/1974 | Gryzbowski et al. | |
| 4,039,189 | A | * | 8/1977 | Headrick et al. | 273/400 |
| 4,461,484 | A | * | 7/1984 | Headrick | 273/400 |
| 4,792,143 | A | * | 12/1988 | Headrick | 273/400 |
| 5,069,441 | A | | 12/1991 | Fang | |
| 5,125,651 | A | | 6/1992 | Keeling et al. | |
| 5,358,255 | A | * | 10/1994 | Jolson | 273/400 |
| 5,452,903 | A | * | 9/1995 | Larrabee | 273/400 |
| 5,662,331 | A | | 9/1997 | Cucci | |
| 5,842,699 | A | | 12/1998 | Mirando et al. | |
| 5,868,395 | A | * | 2/1999 | Headrick | 273/400 |
| 5,893,563 | A | * | 4/1999 | Buller | 273/400 |
| 5,921,551 | A | * | 7/1999 | Dunipace | 273/400 |
| 6,250,635 | B1 | * | 6/2001 | Chittenden | 273/400 |
| 6,468,165 | B1 | | 10/2002 | Moore | |
| 6,494,455 | B1 | * | 12/2002 | Headrick | 273/400 |
| 6,554,285 | B2 | | 4/2003 | Chittenden | |
| 6,776,417 | B1 | | 8/2004 | Holgate | |
| 6,808,176 | B2 | | 10/2004 | Billig et al. | |
| 6,948,713 | B1 | * | 9/2005 | Grunfeld | 273/400 |
| D554,193 | S | * | 10/2007 | Palmeri et al. | D21/305 |
| 7,500,675 | B2 | | 3/2009 | Sandman | |
| 7,621,536 | B2 | * | 11/2009 | Orzech et al. | 273/400 |

* cited by examiner

*Primary Examiner* — Mark S Graham
(74) *Attorney, Agent, or Firm* — William G. Sykes

(57) ABSTRACT

A target apparatus adapted to receive projectiles such as bottle caps tossed or otherwise launched towards the target. Three vertically aligned catch structures are disposed to receive and retain the bottle caps. The three catch structures have different sizes resulting in different degrees of difficulty in projecting a bottle cap into the respective structures. The lowest catch structure is the largest, the middle catch structure being the smallest, and the uppermost catch structure being sized between the lower and the middle structures. Chains completely surround the middle and upper catch structures. Chains only surround the sides and rear of the lowest catch structure. An opening in the front of the lowest catch structure is adapted to receive a projectile therein that is routed to a special basket. A scoring system is provided that awards points depending upon which of the catch structures retains a bottle cap.

12 Claims, 3 Drawing Sheets

BOTTLE CAP GOLF APPARATUS AND METHOD

FIELD OF THE INVENTION

The invention pertains to projectile games and, more particularly, to an apparatus for playing a golf-like game using beverage bottle caps.

BACKGROUND OF THE INVENTION

Many people patronize restaurants, bars, clubs, and other establishments where bottled beverages are served and consumed. In such establishments, friends often congregate and participate sometime in games. Such games include tabletop games provided by the establishment for use by patrons as well as coin-operated games such as pinball machines or electronic video games.

Some beverage serving establishments attempt to obtain a competitive edge by obtaining more or better games for the entertainment of their patrons.

In many beverage-serving establishments, beverages are provided in bottles having removable caps. The caps may be accumulated and used to play various games. Some possible games involve launching a bottle cap towards a target. A scoring system may be established, where points are scored depending upon the accuracy with which a bottle cap is launched at a target. Such games may be played competitively by two or more individuals.

DISCUSSION OF THE RELATED ART

Many projectile games are known in the prior art. For example, U.S. Pat. No. 1,211,379 for GAME APPARATUS, issued Jan. 2, 1917 to A. T. Maisch discloses a game apparatus having multiple pockets arranged on at least two different vertical levels.

U.S. Pat. No. 3,825,262 for HAND-HELD AMUSEMENT DEVICE WITH TETHERED BALL AND PLURAL TARGETS, issued Jul. 23, 1974 to Andrzej Grzybowski et al. provides a game having a flat substrate having ball-receiving pockets arranged on a surface thereof. The ball-receiving pockets are arranged on at least two vertical levels.

U.S. Pat. No. 5,069,441 for BASKETBALL TRAINING ASSEMBLY WITH MULTIPLE HOOPS, issued Dec. 3, 1991 to Yao-chien Fang provides a traditional basketball backboard having three concentric hoops of diminishing diameters mounted thereupon.

U.S. Pat. No. 5,125,651 for BASKETBALL TRAINING SYSTEM, issued Jun. 30, 1992 to Edward J. Keeling et al. provides a basketball goal having a first basketball hoop mounted at a first elevation above a playing surface and a second basketball hoop mounted below the first basketball hoop.

U.S. Pat. No. 5,842,699 for BASKETBALL GAME APPARATUS, issued Dec. 1, 1998 to Salvatore Vincent Mirando et al. provides another basketball game having three vertically aligned targets.

U.S. Pat. No. 6,468,165 for MILLENN GOLF, issued Oct. 22, 2002 to Sherrod F. Moore teaches a target for receiving a projectile struck by an ordinary golf club. Two vertically aligned targets are provided.

U.S. Pat. No. 6,494,455 for FLYING DISC ENTRAPMENT DEVICE, issued Dec. 17, 2002 to Edward E. Headrick shows a target assembly having down hanging chains suspended from an upper support structure.

U.S. Pat. No. 6,554,285 for DISC GOLF TARGET, issued Apr. 29, 2003 to Fred C. Chittenden discloses a disc golf target having multiple down hanging chains suspended from a support member.

U.S. Pat. No. 6,776,417 for DISC GOLF TARGET, issued Aug. 17, 2004 to Michael S. Holgate teaches another target device having down hanging chains suspended from an upper canopy.

U.S. Pat. No. 6,808,176 for ENTRAPMENT DEVICE HAVING A NET, issued Oct. 26, 2004 to Daniel A. Billig et al., discloses an entrapment device for capturing projectiles or flying objects.

U.S. Pat. No. 7,500,675 for PORTABLE DISC GOLF TARGET, issued Mar. 10, 2009 to Ian A. Sandman teaches a portable target having a collapsible base. The target has a plurality of down hanging chains.

Published United States Patent Application No. 2008/0153633 for DISC CATCHING DEVICE, published Jun. 26, 2008 upon application by Joshua S. Orzech et al. provides yet another target arrangement having a plurality of down hanging chains.

None of the patents or the published patent application, taken singly, or in any combination are seen to teach or suggest the novel bottle cap golf target apparatus of the present invention.

SUMMARY OF THE INVENTION

In accordance with the present invention there is provided a target apparatus adapted to receive projectiles such as bottle caps tossed or otherwise launched towards the target. Three vertically aligned catch structures are disposed to receive and retain the bottle caps. The three catch structures have different sizes resulting in different degrees of difficulty in projecting a bottle cap into the respective structures. The lowest catch structure is the largest, the middle catch structure being the smallest, and the uppermost catch structure being sized between the lower and the middle structures. Chains completely surround the middle and upper catch structures. Chains only surround the sides and rear of the lowest catch structure. An opening in the front of the lowest catch structure is adapted to receive a projectile therein that is routed to a special basket.

One possible scoring strategy awards 1 point for a bottle cap successfully launched into the opening in the front of the lowest catch structure; two points for a bottle cap launched into the middle (smallest) catch structure; three points for a bottle cap launched in the upper catch structure; and four points for a bottle cap launched into the lowest catch structure. A bottle cap completely missing the target apparatus is awarded five points. As in golf, the lowest total score is the winning score.

It is, therefore, an object of the invention to provide a bottle cap golf target apparatus.

It is another object of the invention to provide a bottle cap golf target apparatus having three catch structures of varying sizes aligned one above another.

It is an additional object of the invention to provide a bottle cap golf target apparatus having an opening in the front of the largest of the three catch structures.

It is a further object of the invention to provide a bottle cap golf target apparatus wherein spaced apart chains completely surround the smallest and middle sized catch structures.

It is a still further object of the invention to provide a bottle cap golf target apparatus wherein spaced apart chains partially surround the largest of the catch structures.

It is yet another object of the invention to provide a bottle cap golf target apparatus having interchangeable support bases for use on either a solid horizontal surface or on an earthen surface.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENT

The present invention provides an apparatus for receiving launched bottle caps in a plurality of targets and for generating a score associated with each of the plurality of targets.

Figure 1:
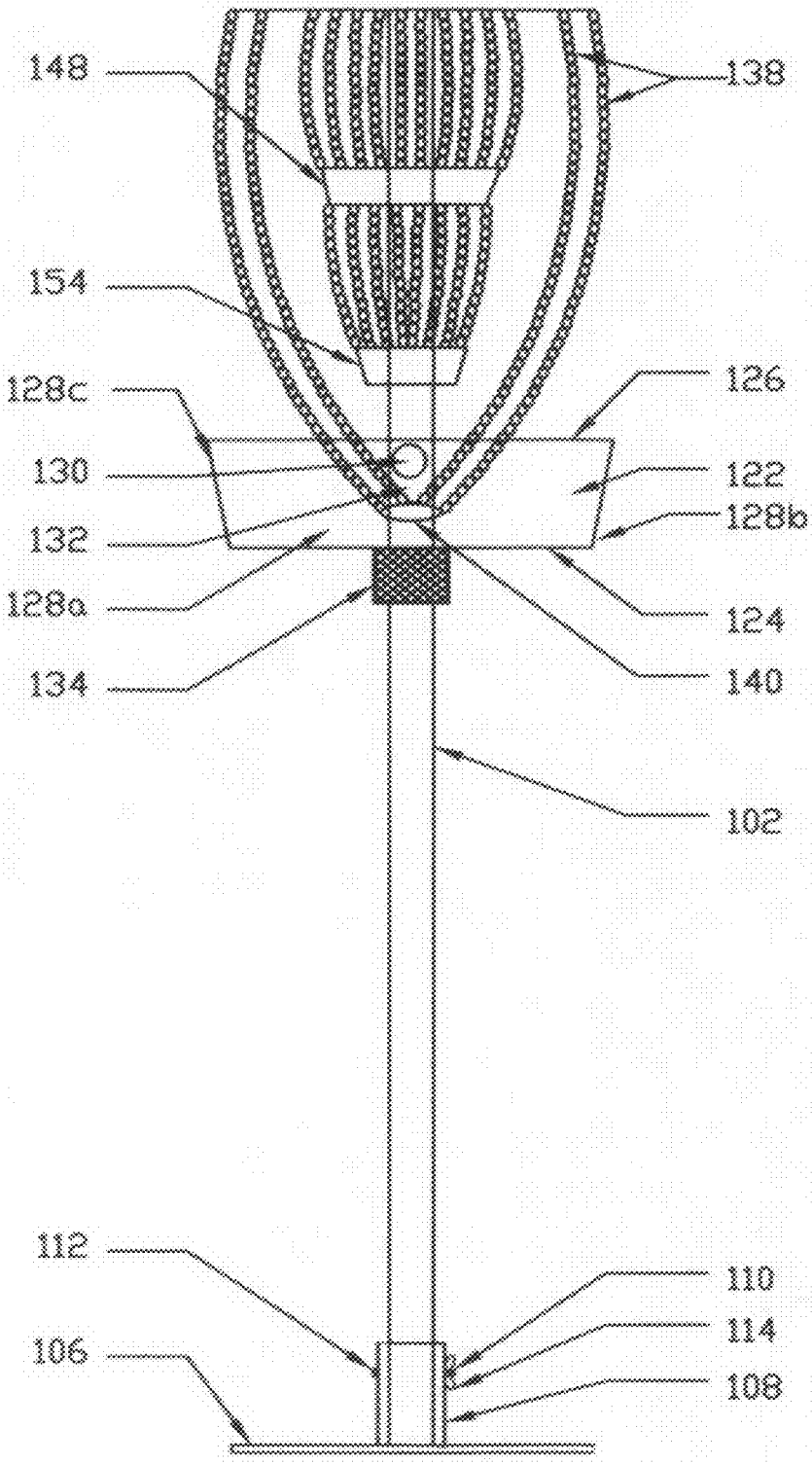
FIG. 1 is a front, elevational view of the target apparatus of the invention.
Figure 3:
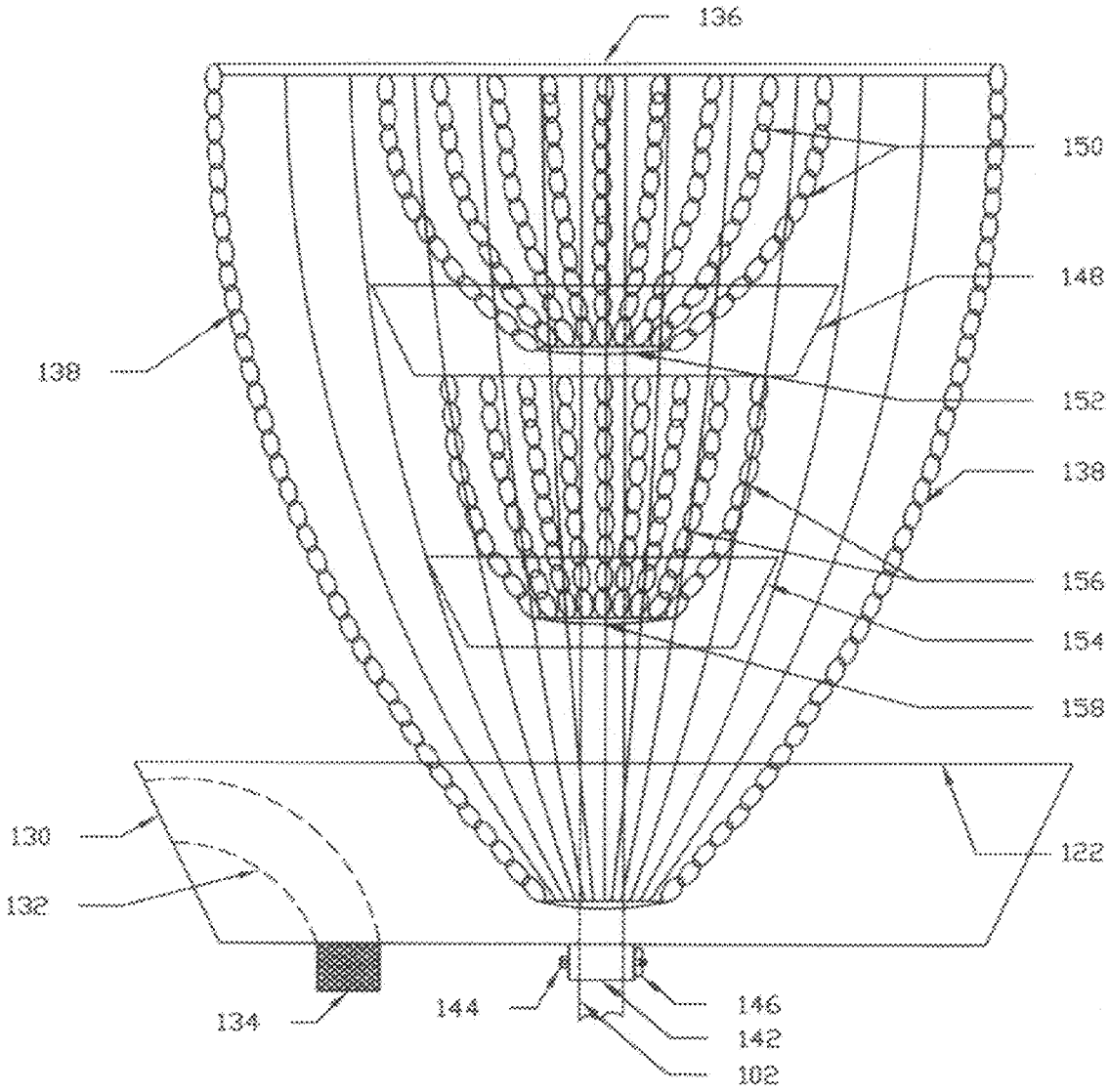
FIG. 3 is a right side elevational view of the apparatus of FIG. 1.

Referring to FIGS. 1 and 3, there are shown front elevational and side elevational views, respectively, of the target apparatus of the invention, generally at reference number 100.

A central support pole 102 is anchored to a support base 104. In the embodiment chosen for purposes of disclosure, central support pole 102 has a circular cross sectional area and an outside diameter of approximately 1.5 inches. It will be recognized that central support poles having other than circular cross sectional area and/or diameters other than approximately 1.5 inches may be substituted thereof. Consequently, the invention is intended to include any cross sectional shape and/or diameter.

A support base 104 is disposed at a distal, lower end of central support pole 102. Support base 104 consists of a support base flat plate 106 adapted to sit on a floor, not shown, or other horizontal environmental substrate, not shown.

A hollow support base receiving cylinder 108 is fixedly attached to support base flat plate 106 in a normal orientation to an upper, major surface of flat plate 106. An inside diameter of hollow base receiving cylinder 108 is sized to accommodate the outside diameter of central support pole 102.

A fastening mechanism 110 is provided to secure central support pole 102 in base receiving cylinder 108. In the embodiment chosen for purposes of disclosure, a through bolt 112 having threads at least a distal end thereof is passed through aligned holes, not specifically identified, in both central support pole 102 and base receiving cylinder 108. Through bolt 112 is secured by a wing nut 114 or other similar device. Alternate securing mechanisms are considered well known to those of skill in the art and, consequently, the inventions is not considered limited to the threaded through bolt 112 and wing nut 114 chosen for purposes of disclosure. Rather, the invention includes any suitable securing mechanism.

Figure 2:
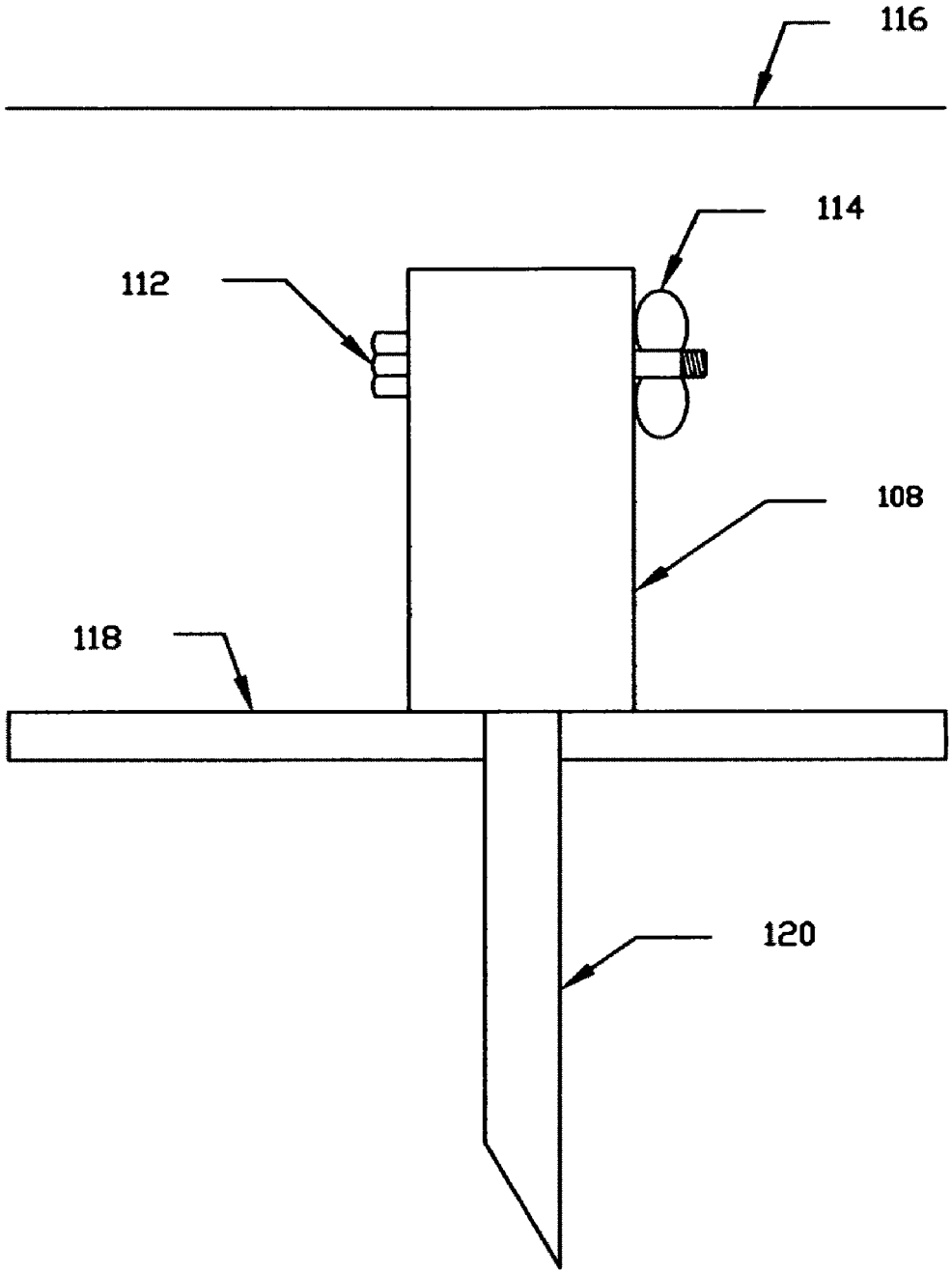
FIG. 2 is a detailed view of an alternate embodiment of a mounting base for the apparatus of FIG. 1.

An alternate support base 116 is shown in FIG. 2. Alternate support 116 also has an alternate flat base plate 118 that may, if desired, be smaller than support base flat plate 106. A base receiving cylinder 108 and fastening mechanism 110 are also provided. Flat base plate 118 has a spike 120 attached to a lower major surface thereof, also in a normal orientation thereto. Spike 120 is adapted to secure alternate flat base plate 118 to the ground, allowing the novel bottle cap apparatus 100 of the invention to be deployed and used outdoors.

A lower cap catching structure 122 is attached to central support pole 102 at a suitable distance away from support base 104 or 116. Lower cap catching structure has a closed bottom 124, an open top 126, and four sloped sides 128*a*-128*d*. Lower cap catching structure 122 is typically square although other shapes are possible. Lower cap catching structure 122 is secured to central pole 102 by a clamp mechanism 142 (best seen in FIG. 3). In the embodiment chosen for purposes of disclosure, clamp mechanism 142 consists of a through bolt 144 and a wing nut 146. It will be recognized that other suitable clamp mechanisms are known to those of skill in the art and such mechanisms may readily be substituted for the disclosed through bolt 144 and wing nut 146 arrangement. Consequently, the invention is not considered limited to any particular clamp arrangement. Rather, the invention is intended to include any suitable clamp arrangement.

A circular "hole in one" opening 130 in front side 128*a* of lower cap catching structure 122 is connected to a proximal end of 90° elbow 132 that is located within lower cap catching structure 122. A distal end of 90° elbow 132 is connected to a removable "hole in one" cap catching basket 134 disposed beneath lower cap catching structure 122. An opening, not shown, is provided in lower surface 124 of lower cap catching structure 122 allowing communication between the distal end of 90° elbow 132 and removable "hole in one" cap catching basket 134.

A solid, circular top 136 is affixed to central support pole 102 at an uppermost end thereof.

A plurality of outer chains 138 each have an upper, distal end affixed to solid circular top 136 and a lower, proximal end affixed to a lower chain securing ring 140 that is suspended by upper chains 138 and is free to move in a vertical direction on central support pole 102. Outer chains 138 are chosen and spaced apart so as to allow a bottle cap to pass between any two of outer chains 138. In the embodiment chosen for purposes of disclosure, the chain spacing is approximately one-half inch. However, other spacings may be chosen and the invention is not considered limited to this particular spacing.

Outer chains 138 are disposed around approximately 270 degrees of circular solid circular top 136 with the portion facing the front of apparatus 100 being devoid thereof.

An upper cap catching structure 148 is attached to central support pole 102 using any suitable mechanism, not shown. Upper cap catching mechanism 148 has a construction similar to lower cap catching structure 122, that is a closed bottom, an open top, and sloped sides, none of which are specifically identified. The overall size of upper cap catching structure is smaller that than the overall all size of lower cap catching structure 122.

Inner chains 150 each have upper, distal ends affixed to solid circular top 136 and lower, proximal ends that are fastened to upper chain securing ring 152. Like lower chain securing ring 140, upper chain securing ring 152 is suspended by inner chains 150 and is free to move vertically along central support pole 102. Inner chains 150 are also spaced apart approximately one-half inch but, unlike outer chains 138, are disposed around completely around upper chain securing ring 152, that is in a 360 degree pattern around central support pole 102. The length of inner chains 150 is chosen so that upper chain securing ring 152 is positioned within the body of upper cap catching structure 148 and above the floor, not specifically identified, thereof.

In a similar fashion, middle cap catching structure 154 is secured to central support pole 102. Intermediate cap catching structure 154 and upper cap catching structure 148 also using any suitable mechanism. Middle cap catching structure 154 has a construction similar to both lower cap catching structure 122 and upper cap catching structure 148, that is it has a closed bottom, an open top, and sloped sides, none of which are specifically identified. The overall size of middle cap catching structure 154 is still smaller that than the overall size of upper cap catching structure 148.

Middle chains 156 each have upper, distal ends affixed to a bottom of upper cap catching structure 148 and lower, proximal ends that are fastened to middle chain securing ring 158. Like upper chain securing ring 152, middle chain securing ring 158 is suspended by middle chains 156 and is free to move vertically along central pole 102. Middle chains 156 are also spaced apart approximately one-half inch and, like inner chains 150, are disposed completely around middle chain securing ring 158, that is in a 360 degree pattern around central support pole 102. The length of middle chains 156 is chosen so that middle chain securing ring 156 is positioned within the body of middle cap catching structure 154 and above the floor, not specifically identified, thereof.

In one possible use, bottle caps or other similar projectiles, neither shown, are tossed or otherwise launched towards target apparatus 100. A scoring system may be implemented to evaluate the accuracy of the launch. One possible scoring system is implemented like the well-known game of golf wherein the player with the lowest score is the winner.

In one exemplary game, caps entering opening 130 and trapped in removable cap catching basket 132 receive one point (i.e., are similar to a hole-in-one in a golf game).

Caps landing in middle cap catching structure 154 receive two points. In a similar fashion, caps landing in upper cap catching structure receive three points. Likewise, caps landing in lower cap catching structure 122 receive four points. Finally, caps totally missing target apparatus 100 receive five points. The person receiving the lowest total score at the end of the game is the winner.

It will be recognized that many alternate games and/or scoring systems may be devised and the invention is not considered limited to any particular set of game rules or scoring systems.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A target assembly for retaining projectiles directed thereat, comprising:

a) a central, vertically aligned support column;

b) a first lower catch structure disposed on and secured to said central support column at a first position therealong, said first catch structure having a first size;

c) a second upper catch structure disposed on and secured to said central support column at a second position therealong, said second catch structure having a second size, said second size being smaller than said first size;

d) a third middle catch structure disposed on and secured to said central support column at a third position between said first catch structure and said second catch structure;

e) a top secured to an upper, distal end of said central, vertically aligned support column;

f) a plurality of outer chains, each having a distal end attached to said top and a proximal end attached to the circumference of a first, lower chain securing ring disposed on said central, vertically aligned support column;

g) a plurality of upper chains, each having a distal end attached to said top and a proximal end attached to the circumference of a second, upper chain securing ring disposed on said central, vertically aligned support column; and h) a plurality of middle chains, each having a distal end attached to and depending from a bottom surface of said upper catch structure and a proximal end attached to the circumference of a third, middle chain securing ring disposed on said central, vertically aligned support column.

2. The target assembly for retaining projectiles directed thereat as recited in claim 1, wherein each of said lower catch structure, said upper catch structure, and said middle catch structure comprise a solid bottom, an open top, and four sloped sides sloping outwardly away from said closed bottom.

3. The target assembly for retaining projectiles directed thereat as recited in claim 2, wherein said bottom of each of said lower catch structure, said upper catch structure, and said middle catch structure comprise a rectangle.

4. The target assembly for retaining projectiles directed thereat as recited in claim 3, wherein an area of said bottom of said lower catch structure is larger than an area of said bottom of said upper catch structure, and an area of said bottom of said upper catch structure is larger than an area of said bottom of said middle catch structure.

5. The target assembly for retaining projectiles directed thereat as recited in claim 1, further comprising a base support adapted to removably receive and secure said lower, proximal end of said central column in a substantially vertical orientation.

6. The target assembly for retaining projectiles directed thereat as recited in claim 1, wherein said base support comprises at least one selected from the group: a flat plate having a support base receiving cylinder attached to an upper, major surface thereof in a normal orientation thereto, a fastening mechanism, and a spike disposed on a lower, major surface of a support plate in a substantially normal orientation thereto.

7. The target assembly for retaining projectiles directed thereat as recited in claim 1, wherein said plurality of outer chains comprises a plurality of spaced apart chains disposed around only approximately 270 degrees of said lower chain securing ring.

8. The target assembly for retaining projectiles directed thereat as recited in claim 7, wherein said plurality of outer chains comprises a plurality of spaced apart chains disposed around only approximately 270 degrees of said lower chain securing ring are spaced apart by approximately a one-half inch space.

9. The target assembly for retaining projectiles directed thereat as recited in claim 1, wherein said plurality of upper chains comprises a plurality of spaced apart chains disposed around approximately 360 degrees of said upper chain securing ring.

10. The target assembly for retaining projectiles directed thereat as recited in claim 9, wherein said plurality of upper chains comprises a plurality of spaced apart chains disposed around approximately 360 degrees of said upper chain securing ring are spaced apart by approximately a one-half inch space.

11. The target assembly for retaining projectiles directed thereat as recited in claim 1, wherein said plurality of middle chains comprises a plurality of spaced apart chains disposed around approximately 360 degrees of said middle chain securing ring.

12. The target assembly for retaining projectiles directed thereat as recited in claim 11, wherein said plurality of middle chains comprises a plurality of spaced apart chains disposed around approximately 360 degrees of said middle chain securing ring are spaced apart by approximately a one-half inch space.

* * * * *